US005423993A

United States Patent [19]

Boney, Jr.

[11] Patent Number: 5,423,993

[45] Date of Patent: Jun. 13, 1995

[54] FIBER RECOVERY SYSTEM AND PROCESS

[75] Inventor: John A. Boney, Jr., 411 S. Mulberry, Butler, Ala. 36904

[73] Assignees: John A. Boney; David E. Kelley, both of Butler, Ala.

[21] Appl. No.: 102,774

[22] Filed: Aug. 6, 1993

[51] Int. Cl.[6] ..... B01D 21/26; D21D 5/00

[52] U.S. Cl. ..... 210/787; 210/294; 210/297; 210/388; 210/512.2; 210/806; 210/928; 162/4; 162/55; 162/189; 162/DIG. 9

[58] Field of Search ..... 210/294, 295, 297, 388, 210/512.1, 512.2, 787, 806, 928; 162/4, 5, 55, 189, DIG. 9; 209/12, 17, 250

[56] References Cited

U.S. PATENT DOCUMENTS

| | | | |
|---|---|---|---|
| 3,849,245 | 11/1974 | Marsh et al. . | |
| 3,951,731 | 4/1976 | Jetzer . | |
| 3,957,572 | 5/1976 | Eriksson et al. . | |
| 4,017,033 | 4/1977 | Tra . | |
| 4,200,486 | 4/1980 | Vagac et al. . | |
| 4,332,638 | 6/1982 | Mauer et al. . | |
| 4,334,984 | 6/1982 | Vagac et al. . | |
| 4,381,969 | 5/1983 | Ceuster et al. . | |
| 4,405,450 | 9/1983 | Selder . | |
| 4,415,430 | 11/1983 | York | 210/806 |
| 4,704,201 | 11/1987 | Keck . | |
| 4,726,880 | 2/1988 | Smith | 162/5 |
| 4,780,179 | 10/1988 | Clement . | |
| 4,842,688 | 6/1989 | Gullichsen et al. . | |
| 5,013,454 | 5/1991 | Hynninen . | |
| 5,075,015 | 12/1991 | Kamke . | |
| 5,137,599 | 8/1992 | Maxham | 162/4 |

FOREIGN PATENT DOCUMENTS

| | | |
|---|---|---|
| 2061133 | 5/1981 | United Kingdom . |
| 2115030 | 9/1983 | United Kingdom . |
| WO87/05954 | 10/1987 | WIPO . |
| WO92/08001 | 5/1992 | WIPO . |

OTHER PUBLICATIONS

Forsell, B., "New Method of Fiber Recovery From Pulp And Paper Waste Sludge," Paper Trade Journ El. (Mar. 8, 1971), pp. 34–38.

"Fiber Recovery Systems Custom-Tailored to Mills," Paper Trade Journal, (Jul. 16, 1973), New Products for Mills, p. 20, col. 1–2.

*Primary Examiner*—Robert A. Dawson
*Assistant Examiner*—David A. Reifsnyder
*Attorney, Agent, or Firm*—Oblon, Spivak, McClelland, Maier & Neustadt

[57] ABSTRACT

A system for recovering fiber from sludge by-products generated in a pulp and paper mill. Initially, heavy materials are separated from a sludge flow, with the flow thereafter separated into first and second components. High grade fiber is recovered from the first component by centrifugal cleaners and also by optional fine pressure screens. The second component is forwarded to a refiner which breaks-down the second component to form a low grade pulp. In addition, after removal of the high grade fiber, remnants from the first component flow are forwarded to an additional separator such as a liquid cyclone, which removes sand, grit and ash, and thereafter the remnants of the first component can be sent to the refiner for forming a low grade pulp. Thus, the sludge is essentially separated into four components including: (1) high grade pulp; (2) low grade pulp; (3) heavy materials; and (4) sand, grit and ash.

32 Claims, 3 Drawing Sheets

FIBER RECOVERY SYSTEM AND PROCESS

BACKGROUND OF THE INVENTION

1. Field of the Invention

The invention relates to the recovery of useful products from sludge by-products of a pulp and paper operation. In particular, the present invention provides a system and process which can remove usable pulp, both low grade and high grade, from pulp sludge. In addition, heavy materials, such as rocks and scrap iron, as well as sand and grit are separated from the sludge for subsequent use or disposal.

2. Discussion of Background

Typically, after screening and pressing operations in a paper mill, a resultant waste sludge product remains which itself is not suitable for making paper or other products. In the past, systems have been developed to remove usable fibers from the sludge for subsequent use. For example, Maxham U.S. Pat. No. 5,137,599 discloses a system in which pulp and paper mill sludge can be converted to papermaking pulp. However, since the emphasis of Maxham is only upon recovering fiber usable in papermaking, only a small portion of the sludge is converted into a usable product. Thus, the remainder of the sludge is discarded, and the resultant small portion of usable pulp is reclaimed at a high cost. In addition to the large amounts of waste remaining and the high cost of reclaiming usable pulp in the Maxham system, the system is fairly complicated and requires the use of detergents.

Accordingly, a system and process are needed which can be used to economically reclaim usable pulp from sludge by-products of a pulp and paper mill. Preferably, such a system should be capable of removing other by-products from the sludge in addition to the removal of usable pulp. Further, such a system and process should most preferably be capable of producing or reclaiming different grades of pulp. Thus, the system should be capable of separating the sludge by-product into a number of usable products, thereby decreasing the discarded waste and also increasing the economical efficiency of the system.

SUMMARY OF THE INVENTION

Accordingly, it is an object of the present invention to provide a system and process for separating pulp and paper mill sludge into plural usable products.

It is another object of the invention to provide a pulp and paper mill sludge handling system and process which can separate both high and low grade pulp from the sludge.

It is a further object of the invention to provide a sludge handling system which separates the sludge into usable components, and which is adaptable to provide varying qualities of pulp products removed from the sludge.

It is yet another object of the present invention to provide a pulp and paper mill sludge handling system and process which can separate one or more usable non-pulp components as well as usable pulp components from the sludge.

It is a still further object of the present invention to provide a pulp and paper mill sludge handling system in which heavy materials are initially removed from a flow of sludge, thereby allowing for subsequent separation of one or more pulp components from the sludge.

These and other objects and advantages are achieved in accordance with the present invention in which sludge is removed from a pulper and held in a storage tank. The sludge from the storage tank is pumped to a liquid cyclone which separates the heavy materials such as scrap iron or rocks. The sludge exiting from the liquid cyclone is then collected in a collector tank at which water can be added to maintain the collector tank at a desired level and to avoid depletion of the collector tank. The sludge is then pumped from the collector tank to a coarse pressure screen, with the accepts from the coarse pressure screen (i.e., the material passing through the coarse pressure screen) collected by a further collector tank from which, after further separation by centrifugal cleaners, a high grade pulp is reclaimed from the sludge. The rejects from the coarse pressure screen (i.e., the material passing over the coarse pressure screen) are then sent to a vibratory screen, with the accepts from the vibratory screen also sent to a collector tank for subsequent reclaiming of additional high grade pulp. The rejects from the vibratory screen are fed to a refiner or grinder in order to produce a low grade pulp. A first system and process in accordance with the present invention provides a relatively simple construction with a high output rate. A second embodiment of the present invention is slightly more complicated, but is suitable for producing higher grade pulp, and is also suitable for providing a bleached pulp product, since it can reclaim pulp of a sufficient quality and grade suitable for bleaching.

BRIEF DESCRIPTION OF THE DRAWINGS

The above objects, as well as additional objects and advantages of the present invention will become readily apparent from the following detailed description, particularly when considered in conjunction with the accompanying drawings in which.

DETAILED DESCRIPTION OF THE PREFERRED EMBODIMENTS

Figure 1:
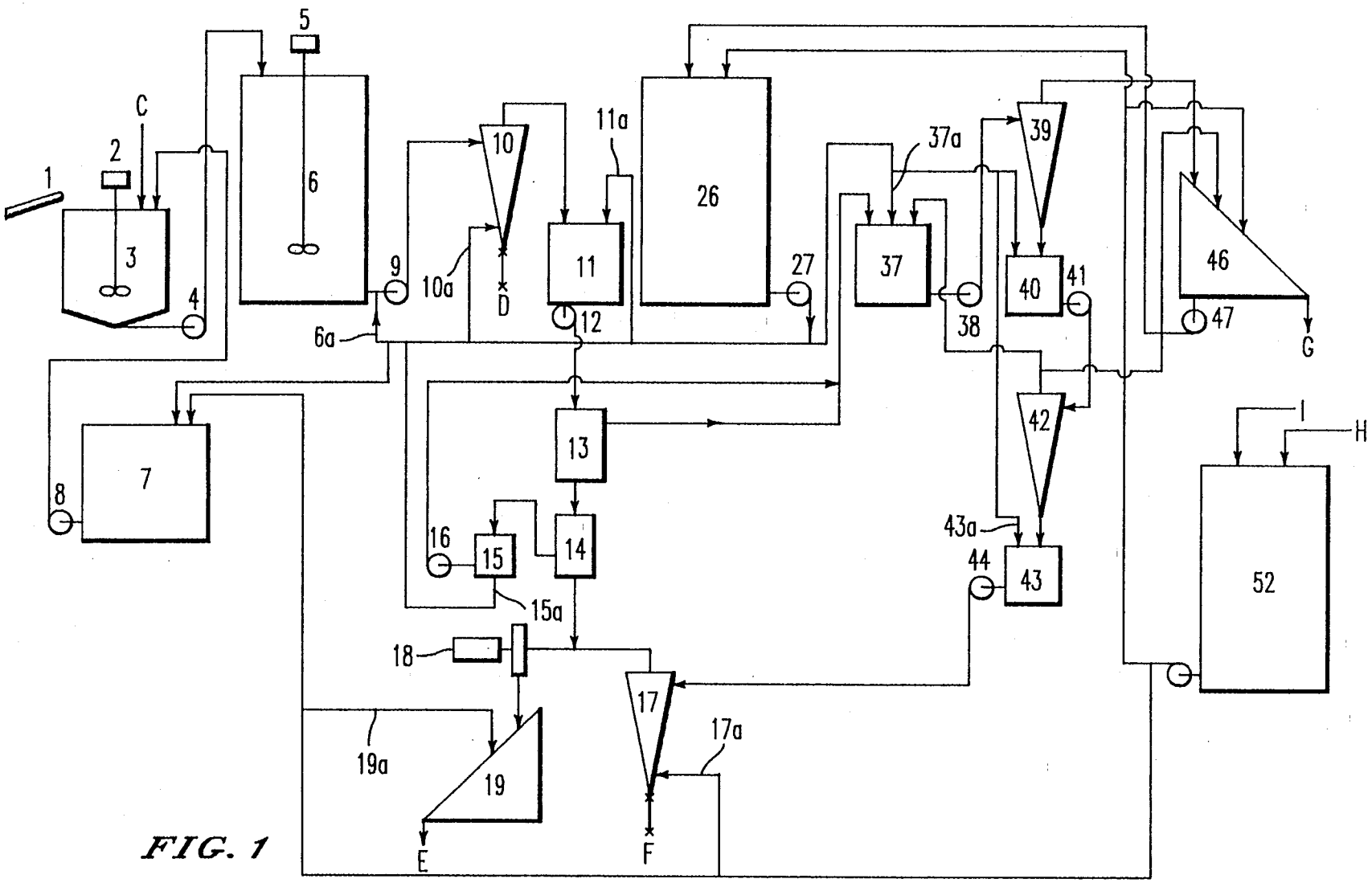
FIG. 1 is a schematic diagram of a first embodiment of the present invention.

Referring now to the drawings, wherein like reference numerals designate identical or corresponding parts throughout the several views, FIG. 1 illustrates a first, more simplified form of the present invention. As shown in FIG. 1, a conveyor 1 feeds sludge by-products from a pulp and paper mill into a pulper 3 which includes an agitator 2. Acid and water are added into the pulper to modify the pH as well as to provide a proper consistency of the sludge. Typically the sludge will enter the pulper tank 3 with a composition of approximately 25–50% fiber and the remainder primarily water. Water is added such that the fiber content is approximately 4–6% to allow the flow to be pumped to the various components of the system. Further, in accordance with one aspect of the present invention, it has been recognized that the reclaiming of usable materials from the sludge is enhanced by the addition of an acid (as indicated at C in the drawing Figures), for example sulfuric acid, in order to lower the pH of the sludge. Typically, the sludge will have a pH of approximately 6–10, however, with the addition of an acid, the pH is reduced to 6–7. As a result, the ability to efficiently reclaim usable products from the sludge is enhanced, since water can be more readily removed from the pulp fiber. This is particularly important since, as will become apparent hereinafter, in addition to the water added to pulper 3, water is added at a number of points throughout the system/process, to make the sludge or sludge components a desired consistency and/or generally to assist in handling of the sludge and sludge components.

Sludge is removed from the pulper 3 via pump 4, and fed into a storage tank 6 which also preferably includes an agitators. Water pumped from tank 26 via pump 27 can be added to the storage tank as indicated at 6*a*. The tank 6 allows for a more steady operation of the system despite varying and sporadic rates of sludge input by conveyor 1. The supplemental water at 6*a* maintains a proper consistency and prevents damage to pump 9 by ensuring the pump does not run dry or pump air. The pump 9 then feeds the sludge to a liquid cyclone 10. As indicated at 10*a*, elutriating water is also fed to the liquid cyclone 10, primarily to prevent fiber from settling out through the bottom of the liquid cyclone. The liquid cyclone 10 will separate the large and heavy debris contained within the sludge, for example, rocks, scrap iron, and large foreign debris, with the heavy material passing through the bottom of the liquid cyclone as indicated at D. The accepts from the liquid cyclone are then fed to a collector tank 11 at which water can also be added as shown at 11*a*. The water maintains the collector tank at a desired level, thereby avoiding problems which could occur with the pump 12 if the tank 11 were depleted. Thus, the addition of water at 11*a* also provides some elasticity in the system, since the pulp or sludge feed into and out of tank 6 as well as in various other components of the system can vary. Water is also added to prevent any of the pumps from pumping air. As mentioned earlier the addition of water is also important in providing a desired consistency of the sludge.

The sludge material in collector tank 11 is then pumped via pump 12 into a coarse pressure screen 13. By way of example, the coarse pressure screen can have hole openings of 0.065 inches. However the size of the openings in the coarse pressure screen can vary depending upon the desired grade of accepts, or other factors, such as the overall throughput of the system and the quality of the initial sludge being processed. The accepts from the coarse pressure screen (i.e., the material passing through the openings in the coarse pressure screen 13) are fed to a collector 37 from which high grade pulp is ultimately reclaimed. The rejects from the coarse pressure screen 13 (the material passing over the openings of the coarse pressure screen) are fed to a vibratory screen 14. The vibratory screen 14 can include, for example, openings on the order of one-eighth of an inch, with the accepts from the vibratory screen 14 fed to a collector 15. As with other collectors, water may also be fed to the collector 15 as shown at 15*a*.

The rejects from the vibratory screen (the material passing over the openings of the vibratory screen) are then fed to a refiner which includes a motor driven grinding arrangement 18. The refiner can be a single or double disk refiner which respectively include two or three grooved disks. The rejects from the vibratory screen (which typically include hard wood pieces, e.g. knots) enter a central portion of the disks and the wood is ground to fiber as it travels between the disks to an outer circumference of the disks. After refining, the resultant material passes to a dewatering device 19 at which additional water can be added as indicated at 19*a*. The additional water (19*a*) performs a washing function in order to wash away any remaining effluents from the pulping process. After dewatering, a low grade pulp is provided as indicated at E.

After removal of the low grade pulp components by screens 13 and 14 described above, the accepts from screens 13 and 14 are fed to the collector 37 at which water (37*a*) may also be added. The material in collector 37 is then fed via pump 38 into a primary centrifugal cleaner 39. As compared with a liquid cyclone (e.g., 10), the centrifugal cleaner 39 is much smaller. For example, the cleaner 39 may have a 4-inch diameter as compared with the liquid cyclone 10 which can have a diameter of approximately 36 inches. It is to be understood, however, that the sizes of both the cyclone separator 10 and the centrifugal cleaner 39 can vary dependent upon flow rates of the system. The centrifugal cleaner 39 will, in general, operate at a much lower consistency (a greater proportion of water as compared with the amount of fiber), and thus can remove smaller particulate matter, such as sand, grit and dirt. Although only a single primary centrifugal cleaner 39 is shown, it is to be understood that a number of centrifugal cleaners can be provided in parallel depending on the capacity and throughput rate of the system, with rejects of each of the primary centrifugal cleaners being fed to collector 40, and the accepts being fed to a dewatering device 46. The rejects from the primary centrifugal cleaner 39 are collected by the collector 40, and thereafter are pumped via pump 41 into a secondary centrifugal cleaner 42.

The secondary centrifugal cleaner 42 is of the same construction as the primary centrifugal cleaner, however, a lower capacity is required for the secondary centrifugal cleaner due to the volume of accepts removed by the primary centrifugal cleaner. Thus, where a plurality of primary centrifugal cleaners 39 are provided, a smaller number of secondary centrifugal cleaners 42 are needed. The material entering the secondary centrifugal cleaners includes sand, grit, and other small particulate debris which was rejected by the primary centrifugal cleaner, however, some high grade pulp, as well as wood particles which can be processed into a low grade pulp, also pass through the primary cleaner 39 with the rejects. Thus, the secondary centrifugal cleaner 42 can reclaim additional pulp material, with the rejects from the secondary centrifugal cleaner passing to collector 43.

A line indicating feed of the accepts from the secondary centrifugal cleaner is not shown since they can be fed either to the collector 37 (such that they are again screened by the primary centrifugal cleaner 39, thereby providing for additional reclaiming of high grade pulp), or the accepts from the secondary centrifugal cleaner 42 may be fed directly to the dewatering device 46. If it is important to provide a clean high grade pulp at G, it is preferable to feed the accepts from the secondary centrifugal cleaner 42 to the collector 37. However, returning the accepts from cleaner 42 to the collector 37 increases the volume of materials entering the collector 37, and therefore, can reduce the overall throughput of the system. Thus, if it is not necessary to provide an extremely clean high grade pulp, feeding the accepts from cleaner 42 directly to the dewatering device 46 can be suitable and increases the throughput of the system. The decision to direct the accepts from cleaner 42 to collector 37 or dewatering device 46 can also be based upon varying qualities of sludge entering the system. Thus, the system is adaptable to differing qualities of pulp desired, different sludge qualities and/or throughput rates.

The rejects from the cleaner 42 which are collected by collector 43 include hard wood particles, such as knots, and other wood pieces, as well as sand, dirt and grit. Thus, the material from collector tank 43 is pumped via pump 44 into a liquid cyclone 17. The liquid cyclone 17 is operated at slower flow speeds as compared with the cyclone 10 and thus separates the sand, grit and ash as shown at F, with the accepts from the screen 17 passing to the refiner 18 with the rejects from the vibratory screen 14. Thus, the accepts from the liquid cyclone 17 can be ground by refiner 18 to produce a low grade pulp. The sand, grit and ash materials F from the liquid cyclone 17 can then be utilized for a variety of purposes, such as a filler material, in forming bricks, roadwork materials, etc. Although some dirt may be carried with the accepts from 17, the dirt is tolerable in a low grade pulp. However, sand and grit must be removed as they can damage equipment or cause premature wear. As shown at 17*a*, elutriating water is supplied to the cyclone 17 to help prevent wood fiber from exiting through the bottom of the cyclone, while the more dense sand, grit and ash exit as shown as F.

In order to ensure an adequate water supply, tanks 7, 26 and 52 are provided. Tank 52 provides a main source which can be replenished by fresh water I and/or recycled water H. It is particularly important to provide a reliable source or separate tank 7 for the pulper 3, since large quantities of water can be required in a short period of time, and the supply of such a large quantity should not adversely affect the other water requirements of the system.

As should be readily apparent from the foregoing, the present invention provides a sludge handling system and process which separates and classifies the sludge into plural usable components. Thus, the amount of waste is greatly reduced as compared with prior systems, with both high and low grade pulp produced (G and E) as well as a usable filler material (F) and heavy materials (D). Depending upon the nature of the heavy materials D, they may be sold as scrap iron, rock, or merely discarded.

Figure 2A:
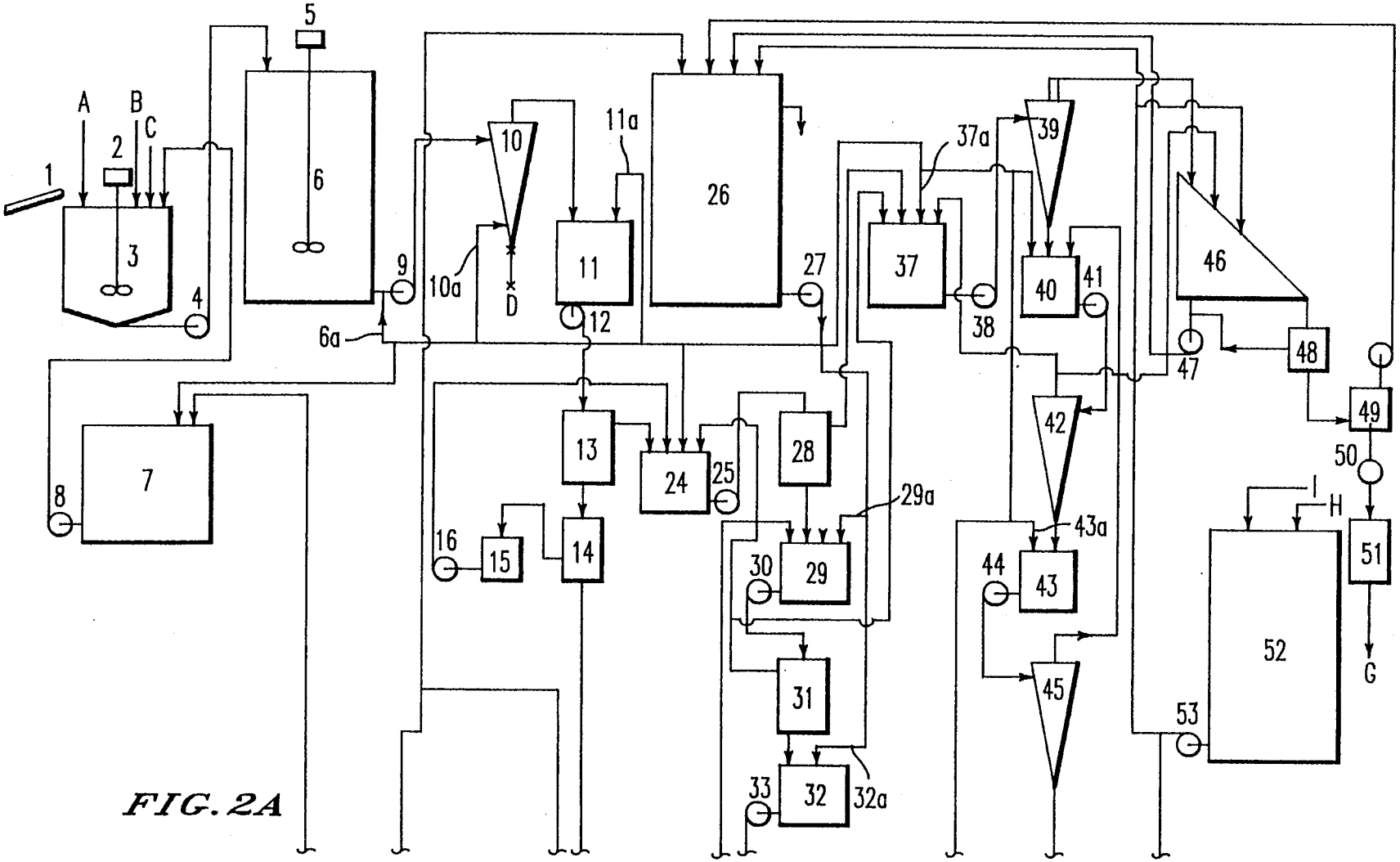
FIGS. 2A and B are schematic diagram of a second slightly more complicated embodiment of the present invention which is capable of yielding a higher quality pulp and which is also suitable for producing a bleached pulp.
Figure 2B:
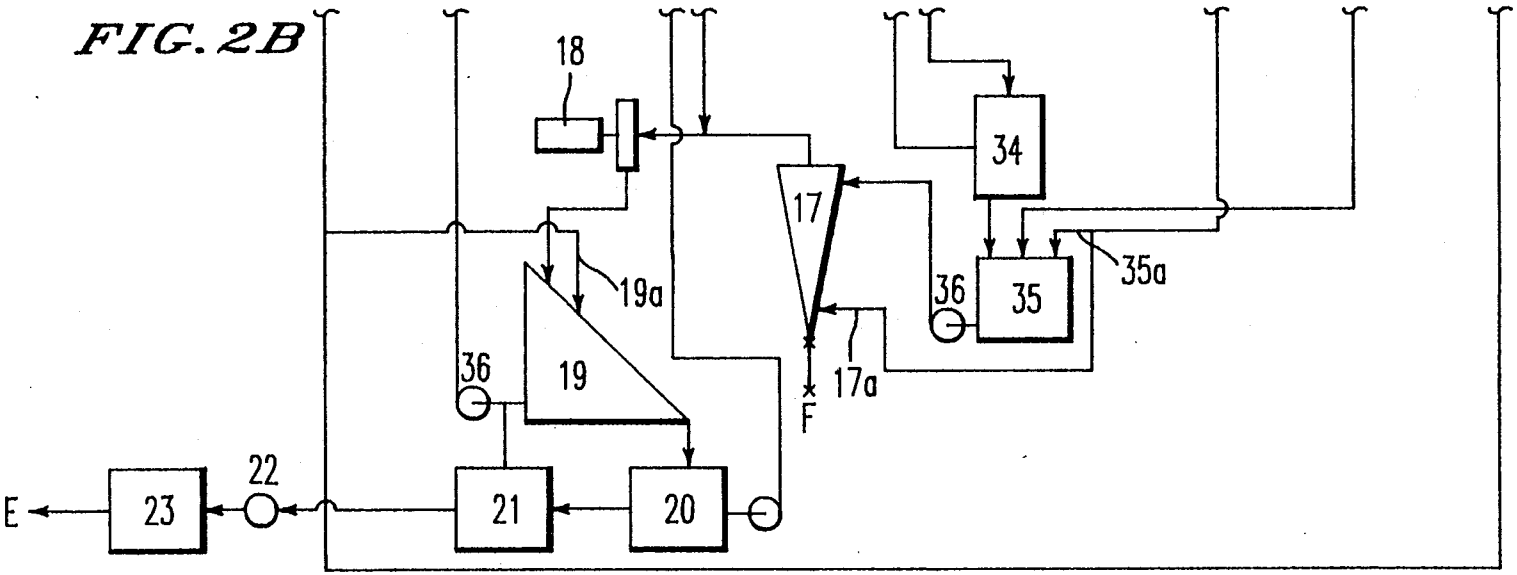

Referring now to FIGS. 2A and B wherein like numerals designate corresponding elements, an alternate embodiment of the present invention is shown. The FIGS. 2A and B embodiment is particularly desirable where the reclaimed pulp is bleached. In particular, where bleaching is desired, the reclaimed pulp must be slightly finer and should not include fiber bundles adhered together, since such larger fiber bundles will not allow the bleach to adequately penetrate, and therefore would result in darkened portions of a product which is to be white or substantially white. Thus, the FIGS. 2A and B embodiment provides a system which is suitable for producing bleached pulp. A caustic and a bleaching chemical can be added to the pulper 3 as indicated at A and B respectively. However, it is to be understood that the FIG. 2 embodiment can also be advantageous where it is desirable to produce a higher grade pulp, even if the pulp is not to be bleached or treated.

Significantly, in the FIGS. 2A and B embodiment, the accepts from the screen 13 are fed to a collector 24, and thereafter fed via pump 25 to a fine pressure screen 28. The fine pressure screen includes slots of, for example, 0.010–0.012 inches in size. The accepts from the fine pressure screen 28 are then fed to the collector 37 for subsequent reclaiming of high grade pulp.

The rejects from the fine pressure screen 28 are fed to a collector 29, and thereafter pumped via pump 30 to a secondary fine pressure screen 31. The accepts from the secondary fine pressure screen can be fed to collector 37 (where higher production rates are desired, or possibly where the initial sludge has a low quantity of dirt, grit and other debris), or the accepts from the screen 31 may be fed back to the collector 24 for additional screening prior to passing to the collector 37 (where it is desired to produce a higher quality pulp). The rejects from secondary fine pressure screen 31 pass to a collector 32, and are pumped to a further tertiary fine pressure screen 35. The accepts from the tertiary fine pressure screen 34 are returned to the collector 24 for additional screening, with the rejects from the tertiary fine pressure screen directed to the collector 35. The rejects collected at 35 are then pumped to the liquid cyclone 17 via pump 36. As in the earlier embodiment, the liquid cyclone 17 separates the grit, sand and ash materials as indicated at F, with the accepts from the liquid cyclone sent to the refiner 18 for grinding. As in the earlier embodiment, a low grade pulp is then yielded after dewatering at 19.

The FIGS. 2A and B embodiment also includes a thickener 20, press 21, fluffer 22 and baler 23, all of which are known devices. However, it is to be understood that elements 20–23 are not needed, but are optional where it is desired to provide the low grade pulp in bales and, if desired, may also be utilized with the FIG. 1 embodiment.

With respect to the fine pressure screens, as noted earlier, the accepts from screen 31 may be directed either to the collector 37, or to the collector 24, for additional screening through the fine pressure screens. However, the accepts from screen 34 are preferably directed back to the collector 29 in order to prevent degradation of the materials in collectors 24 or 37, since the materials entering the screen 34 have already been rejected twice, i.e., by screens 28 and 31. Further, by directing the accepts from screen 34 to the collector 29, the chance of overloading the collector 24 and/or 37 is reduced.

Although the screens 28, 31 and 34 are essentially the same, screens 31 and 34 are successively of lower capacity, since the flow rate of rejects successively decreases. For example, if screen 28 has a capacity of 1500 gallons, a typical output of the rejects would be approximately 500 gallons, and thus the screen 31 can be of a smaller capacity. Similarly, the rejects from screen 31 form a still lower flow rate, such that the screen 34 can be of a still smaller capacity.

The accepts which enter collector 37 are then pumped via pump 38 to a primary centrifugal cleaner (which as discussed in conjunction with the FIG. 1 embodiment, will likely include plural centrifugal cleaners in parallel). The accepts from the primary centrifugal cleaner are directed to the dewatering device 46 to provide a resultant high grade pulp G. A thickener 48, press 49, fluffer 50 and baler 51 may also be optionally provided if it is desired to produce baled pulp. As with the baling arrangement for the low grade pulp E, the devices 48–51 are optional and, if desired, may also be utilized in the FIG. 1 embodiment.

The rejects from primary centrifugal screen 39 are collected by collector 40, and are pumped via pump 41 to a secondary centrifugal cleaner 42. The accepts from secondary centrifugal cleaner 42 are fed to the collector 37 for additional screening by primary centrifugal cleaner 39. The rejects from the secondary centrifugal cleaner 42 are fed to a collector 43, and pumped via pump 44 to a tertiary centrifugal cleaner 45. The accepts from the tertiary centrifugal cleaner 45 are then directed to the collector 40. Although the accepts from the tertiary cleaner 45 may also be directed to the collector 37, it is preferable to direct the accepts to the collector 40 in order to avoid the possibility of the collector 37 being overloaded, and since the flow to cleaner 45 has already been rejected twice by cleaners 39 and 42. The rejects from the tertiary centrifugal cleaner 45 are collected at 35 together with the rejects from the tertiary fine pressure screen, such that a portion of the rejects from cleaner 45 can be processed by refiner 18 to form a low grade pulp, with the grit, sand, and ash removed by liquid cyclone 17. The sand, grit and ash can be used as a filler material F.

Thus, the present invention provides a fiber recovery system and process in which heavy materials are initially removed followed by separation into first and second components (by screens 13 and 14) from which high grade and low grade pulp can be recovered. The high grade pulp is then removed from the first component, with remnants from the first component joining (after removal of sand, grit and ash) the second component for refining to form a low grade pulp. The high grade pulp and low grade pulp can be used for appropriate products, while the sand, grit and ash can be utilized as a filler material. The heavy materials may also be marketable, and even if they are not marketable, they can be more readily handled and constitute a much smaller proportion of waste product as compared with prior art systems and processes.

Obviously, numerous modifications and variations of the present invention are possible in view of the foregoing teachings. It is therefore to be understood that, within the scope of the appended claims, the invention may be practiced otherwise than as specifically described herein.

What is claimed as new and desired to be secured by Letters Patent of the United States is:

1. A system for recovering fiber from sludge of a pulp and paper mill in which the sludge includes a high grade pulp, wood particles and contaminants, with the contaminants including heavy materials comprising:

a separator device for removing heavy materials from a flow of said sludge;

a screening system downstream of said separator device for separating the flow of said sludge into first and second components with said first component including high grade pulp and said second component including wood particles;

a cleaning system for removing high grade pulp from said first component, said cleaning system including at least one centrifugal cleaner; and a refiner for refining said second component to form a low grade pulp, said refiner including means for breaking down a size of wood particles in said second component to form said low grade pulp.

2. The system of claim 1, further including a first dewatering device downstream from said cleaning system for removing water from the high grade pulp removed by said cleaning system and a second dewatering device downstream from said refiner for removing water from the low grade pulp.

3. The system of claim 1, wherein said contaminants further include particulate matter including at least one of sand, grit and ash, the system further including a second separator device for receiving remnants of said first component after said high grade pulp has been removed, said second separator device removing the particulate matter, and thereafter forwarding the remnants of said first component to said refiner.

4. The system of claim 1, wherein said screening system includes a coarse pressure screen and a vibratory screen.

5. The system of claim 4, wherein said coarse pressure screen receives the flow from said separator device, and a portion of the flow which passes through said coarse pressure screen forms part of said first component and a portion of the flow passing over the coarse pressure screen is fed to the vibratory screen;

said vibratory screen receiving the portion of the flow passing over the coarse pressure screen, and wherein the portion of the flow passing through the vibratory screen forms the remainder of the first component and the flow passing over the vibratory screen forms said second component.

6. The system of claim 1, wherein said cleaning system includes a primary centrifugal cleaner, and wherein an accepts flow from the primary centrifugal cleaner is fed to a dewatering device to yield said high grade pulp, said cleaning system further including a secondary centrifugal cleaner which receives a rejects flow from said primary centrifugal cleaner, wherein an accepts flow from said secondary centrifugal cleaner is fed to at least one of said primary centrifugal cleaner and said dewatering device.

7. The system of claim 6, wherein said contaminants further include sand, grit and ash, the system further including a second separator device which receives a rejects flow from said secondary centrifugal cleaner and which removes sand, grit and ash therefrom, and wherein after removal of sand, grit and ash, the flow to the second separator device is forwarded to said refiner.

8. The system of claim 1, further including a second screening system upstream of said cleaning system.

9. The system of claim 8, wherein said second screening system includes a plurality of fine pressure screens.

10. The system of claim 8, wherein said cleaning system includes a plurality of centrifugal cleaners.

11. The system of claim 1, wherein said separator device includes a liquid cyclone, and said screening system includes a coarse pressure screen and a vibrating screen.

12. A process for recovering fiber from sludge of a pulp and paper mill in which said sludge includes a high grade pulp, wood particles and contaminants, with said contaminants including heavy materials, the method comprising:

feeding a flow of said sludge to a separator device and removing the heavy materials with said separator device;

forwarding the flow from said separator device to a screening system and separating the flow into first and second components with said screening system;

feeding the first component to a cleaning system including at least one centrifugal cleaner for removing high grade pulp from said first component; and feeding the second component to a refiner which breaks down wood particles of said second component to form a low grade pulp.

13. The process of claim 12, further including feeding the high grade pulp removed by said cleaning system to a first dewatering device, and feeding the low grade pulp from said refiner to a second dewatering device.

14. The process of claim 12, wherein said contaminants further include sand, grit and ash, the process further including, after removal of said high grade pulp by said cleaning system, feeding remnants from said first component to a second separator device and removing sand, grit and ash from the remnants of said first component, and thereafter forwarding the remnants of said first component to said refiner.

15. The system of claim 12, wherein the step of feeding the flow to a screening system for separating the flow into first and second components includes feeding the flow from the separator device to a coarse pressure screen such that a portion of the flow which passes through the coarse pressure screen forms part of said first component, and feeding a portion of the flow passing over the coarse pressure screen to a vibratory screen of said screening system, and wherein the portion of the flow passing through the vibratory screen forms the remainder of the first component and the flow passing over the vibratory screen forms said second component.

16. The process of claim 12, further including feeding said first component formed by said screening system to a second screening system prior to feeding said first component to said cleaning system.

17. The process of claim 16, further including feeding remnants of said second screening system to said refiner.

18. The method of claim 16, further including feeding remnants of said second screening system to a liquid cyclone and then to said refiner.

19. The process of claim 18, further including feeding remnants of said at least one centrifugal cleaner of said cleaning system to said liquid cyclone.

20. The process of claim 12, wherein the step of removing heavy materials by a separator device includes removing heavy materials by a liquid cyclone, and wherein the step of separating the flow into first and second components by a screening system includes separating said flow into first and second components by a coarse pressure screen and a vibratory screen.

21. A system for recovering fiber from sludge of a pulp and paper mill in which the sludge includes a high grade pulp, wood particles and contaminants, said contaminants including heavy materials, the system comprising:

a liquid cyclone for receiving a flow of said sludge and for removing heavy materials from said flow;

a coarse pressure screen downstream of said liquid cyclone;

a vibratory screen downstream of said coarse pressure screen, said vibratory screen receiving a rejects flow from said coarse pressure screen;

a refiner downstream of said vibratory screen, said refiner including means for breaking down a size of said wood particles, said refiner receiving a rejects flow from said vibratory screen which includes wood particles and breaking down said wood particles of said rejects flow from said vibratory screen to form a low grade pulp;

a centrifugal cleaner downstream of said coarse pressure screen and said vibratory screen, said centrifugal cleaner receiving an accepts flow from said coarse pressure screen and an accepts flow from said vibratory screen; and a dewatering device downstream of said centrifugal cleaner for receiving an accepts flow from said centrifugal cleaner and removing water therefrom to yield a high grade pulp.

22. The system of claim 21, wherein said contaminants further include sand, grit and ash, the system further including a second liquid cyclone downstream of said centrifugal cleaner, said second liquid cyclone receiving a rejects flow from said centrifugal cleaner and separating sand, grit and ash therefrom, and wherein said refiner receives an accepts flow from said second liquid cyclone.

23. The system of claim 21, further including a collector which receives an accepts flow from said coarse pressure screen and an accepts flow from said vibratory screen, and wherein said centrifugal cleaner receives said accepts flows after being collected in said collector.

24. The system of claim 21, wherein a pair of said centrifugal cleaners are provided, a first of said pair of centrifugal cleaners receiving the accepts flow of said coarse pressure screen and the accepts flow from said vibratory screen, with an accepts from said first centrifugal cleaner being fed to the dewatering device, and wherein a rejects flow from said first centrifugal cleaner is fed to a second of said pair of centrifugal cleaners, and further wherein an accepts flow from said second centrifugal cleaner is fed to one of said first centrifugal cleaner and said dewatering device.

25. The system of claim 21, further including a fine pressure screen receiving the accepts flow from the coarse pressure screen and the accepts flow from the vibratory screen, and wherein an accepts flow from said fine pressure screen is fed to said centrifugal cleaner.

26. The system of claim 21, further including a plurality of fine pressure screens, and wherein an accepts flow from said plurality of fine pressure screens are fed to said centrifugal cleaner.

27. The system of claim 21, further including a plurality of fine pressure screens receiving an accepts flow from said coarse pressure screen and an accepts flow from said vibratory screen, and wherein rejects flows from said plurality of fine pressure screens are fed to a second liquid cyclone, and wherein accepts flows of said plurality of fine pressure screens are fed to a series of centrifugal cleaners, accepts flows of said series of centrifugal cleaners are fed to said dewatering device, and wherein rejects flows of said series of centrifugal cleaners are fed to said second liquid cyclone, and further wherein said contaminants include sand, grit and ash and said second liquid cyclone removes sand, grit and ash, with an accepts flow of said second liquid cyclone being fed to the refiner.

28. A system for recovering fiber from sludge of a pulp and paper mill in which the sludge includes a high grade pulp, wood particles and contaminants, said contaminants including heavy components, the system comprising:

a separator device for removing heavy components from a flow of said sludge;

a screening system downstream of said separator device for separating the flow into first and second components, wherein said first component includes an accepts flow of said screening system with said accepts flow including high grade pulp, said second component including a rejects flow of said screening system which includes wood particles;

a cleaning system for removing high grade pulp from said first component, said cleaning system including at least one centrifugal cleaner, and wherein an accepts flow of said cleaning system includes said high grade pulp, said cleaning system also producing a cleaning system rejects flow; and a liquid cyclone receiving said cleaning system rejects flow, and producing a liquid cyclone accepts flow for reclaiming wood particles from said cleaning system rejects flow.

29. The system of claim 28, further including a refiner which includes means for breaking down wood particles, said refiner receiving said accepts flow from said liquid cyclone.

30. The system of claim 29, wherein said refiner additionally receives at least part of said second component of said screening system.

31. The system of claim 28, further including a second screening system upstream of said cleaning system and wherein said cleaning system receives an accepts flow from said second screening system, and a rejects flow from said second screening system is fed to said liquid cyclone which receives said cleaning system rejects flow.

32. The system of claim 31, further including a refiner which receives a liquid cyclone accepts flow and breaks down a size of wood particles in said liquid cyclone accepts flow.

* * * * *